US011166487B1

(12) United States Patent
Okamura

(10) Patent No.: US 11,166,487 B1
(45) Date of Patent: Nov. 9, 2021

(54) CIGARETTE MAKING KIT AND METHOD OF USING

(71) Applicant: Ryan Okamura, San Francisco, CA (US)

(72) Inventor: Ryan Okamura, San Francisco, CA (US)

( * ) Notice: Subject to any disclaimer, the term of this patent is extended or adjusted under 35 U.S.C. 154(b) by 381 days.

(21) Appl. No.: 16/244,904

(22) Filed: Jan. 10, 2019

(51) Int. Cl.
*A24C 5/42* (2006.01)
*A24C 5/47* (2006.01)
*A24C 5/46* (2006.01)

(52) U.S. Cl.
CPC ..... *A24C 5/42* (2013.01); *A24C 5/465* (2013.01); *A24C 5/474* (2013.01)

(58) Field of Classification Search
None
See application file for complete search history.

(56) References Cited

U.S. PATENT DOCUMENTS

| | | | | |
|---|---|---|---|---|
| 1,299,050 | A | | 4/1919 | Southmayd |
| 1,681,738 | A | | 8/1928 | Manderson |
| 1,865,943 | A | * | 10/1931 | Miller |
| 2,415,910 | A | | 2/1947 | Roes |
| 3,911,933 | A | | 10/1975 | Crisp et al. |
| 3,927,681 | A | | 12/1975 | Bramhill |
| 4,534,367 | A | | 8/1985 | Newsome |
| 4,832,057 | A | | 5/1989 | Bale et al. |
| 4,887,617 | A | | 12/1989 | Ruppert et al. |
| 5,018,536 | A | | 5/1991 | Liebich |
| 5,133,366 | A | | 7/1992 | Liebich |
| 5,141,000 | A | | 8/1992 | Ruppert et al. |
| 5,749,378 | A | | 5/1998 | Ruppert et al. |
| 6,443,161 | B1 | | 9/2002 | Kaczmarek et al. |
| 2007/0062607 | A1 | * | 3/2007 | Salani et al. ..... B67C 11/04 141/337 |
| 2019/0360856 | A1 | * | 8/2019 | Cai et al. ..... G01G 21/22 |

FOREIGN PATENT DOCUMENTS

WO WO2013076254 A2 5/2013

OTHER PUBLICATIONS

Screen captures from YouTube video clip entitled "Building a Joint Roller! Free and Easy!", uploaded Jun. 29, 2016 by user "PrimeCraftCannabis" at https://www.youtube.com/watch?v=2LKmcVfPN0I (Year: 2016).*

Smoker, Jay, "How to Crutch a Joint", Jul. 1, 2012, https://theweedblog.com/cannabis-tips-and-tricks/how-to-crutch-a-joint (Year: 2012).*

* cited by examiner

*Primary Examiner* — Michael H. Wilson
*Assistant Examiner* — Katherine A Will
(74) *Attorney, Agent, or Firm* — Shlesinger, Arkwright & Garvey LLP

(57) ABSTRACT

Kit for producing a cigarette includes a cigarette tube holding a smoking material, a funnel having a length, a top face, a bottom face, and funnel includes a fold line along which bottom face of funnel is folded relative to the top face to form a slot and a closed bottom face. The funnel receives the smoking material through the slot and fills the funnel with smoking material for filling the cigarette tube. The cigarette tube is filled with the smokable material. The funnel is rollable into a filter, and the filter is inserted into an end of the cigarette tube, and the filter filters smoke from the smoking material and the cigarette tube when the cigarette tube and the smoking material are ignited. There is likewise a method of making a cigarette using the kit.

12 Claims, 4 Drawing Sheets

CIGARETTE MAKING KIT AND METHOD OF USING

FIELD OF THE INVENTION

The invention relates to a kit which is used to make a cigarette. The invention further relates to a method of using the kit to make a cigarette. The invention still further relates to a kit which is used to make a cigarette by filling a cigarette tube with a smoking material.

BACKGROUND OF THE INVENTION

Cigarettes including a smoking material are known.

Apparatuses and methods for making cigarettes are known.

SUMMARY OF THE INVENTION

The invention includes a kit for producing a cigarette. The kit includes a cigarette tube, which holds a smoking material when a smoking material is provided in the cigarette tube. The kit further includes a funnel having a length, a top face, and a bottom face, the funnel including a fold line along which the bottom face of the funnel is folded relative to the top face of the funnel to form the funnel with the top face having a slot and the bottom face being a closed bottom face. Further, the funnel receives the smoking material through the slot and fills the funnel with smoking material for filling the cigarette tube, wherein the cigarette tube is filled with the smokable material. The funnel is rollable into a filter, the filter is inserted into an end of the cigarette tube, and the filter filters smoke from the smoking material and the cigarette tube when the cigarette tube and the smoking material are ignited.

The cigarette tube is one of a circular cigarette tube and a rectangular cigarette tube.

The funnel is paper or a card stock.

The cigarette tube is a pre-rolled cigarette tube.

The cigarette tube includes cigarette paper.

The fold line is a paper score.

The invention includes a method of making a cigarette including providing the kit as detailed above, and producing a cigarette using the kit.

The method of making a cigarette further includes that the funnel rollable into a filter is inserted into the end of the cigarette tube after the cigarette tube is filled with smoking material, after the funnel rollable into a filter is used as a funnel, or before the funnel rollable into a filter is used as a funnel.

Relative terms such as left, right, up, down, first, and second are for convenience only and are not intended to be limiting.

DETAILED DESCRIPTION OF THE INVENTION

FIGS. 1-5 show a kit for making a cigarette filled with a smoking material.

Figure 1:
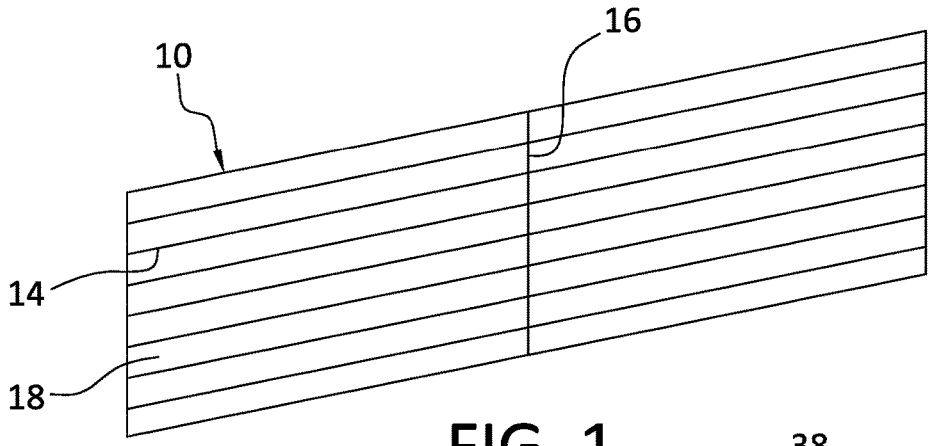
FIG. 1 is a perspective view of a foldable sheet according to the invention.

FIG. 1 shows a foldable sheet 10 which may be made of paper, such as card stock. Foldable sheet 10 may include one or more fold lines, such as paper scores 14, extending lengthwise, and a middle paper score 16 extending widthwise, as shown. Paper scores 14 define respective facets 18 between adjacent score lines 14, and sheet 10 may be folded about scores 14.

Figure 2:
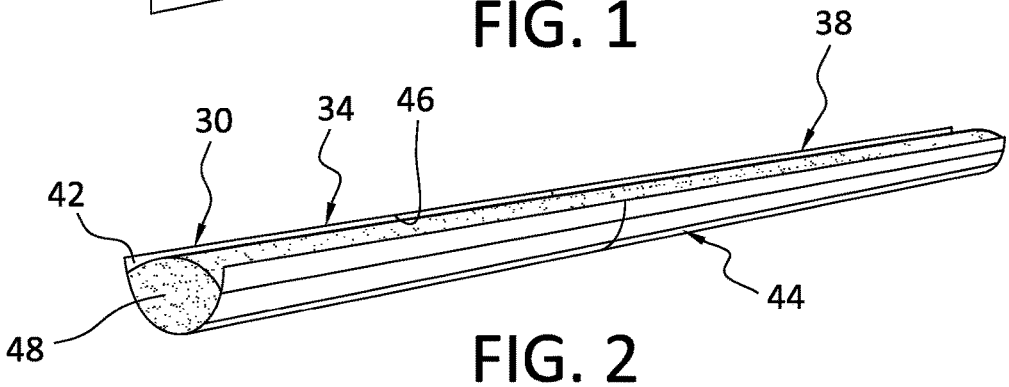
FIG. 2 is a perspective view of a funnel according to the invention.

FIG. 2 shows a funnel 30 having a first half 34 and a second half 38, funnel 30 having been made by folding or rolling a top face 42 inwardly by rolling up a bottom face 44 around top face 42. The rolled up foldable sheet is rolled up so that a slot 46 is formed through which a smoking material 48 is received in funnel 30.

Figure 3:
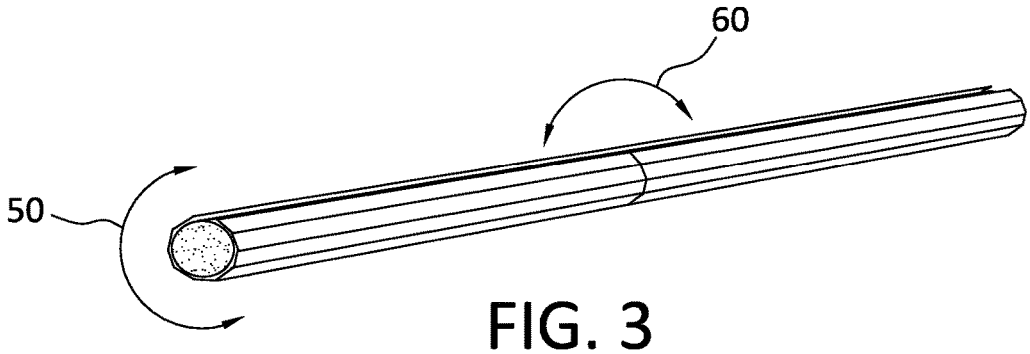
FIG. 3 is a further perspective view of a foldable sheet according to the invention.

Funnel 30 as shown in FIG. 3 may be further rolled up to a smaller diameter than in FIG. 2. A force showing that further rolling up of funnel 30 is represented by a double-headed arrow 50. A force to separate first half 34 from second half 38 is represented by a double-headed arrow 60.

Figure 4:
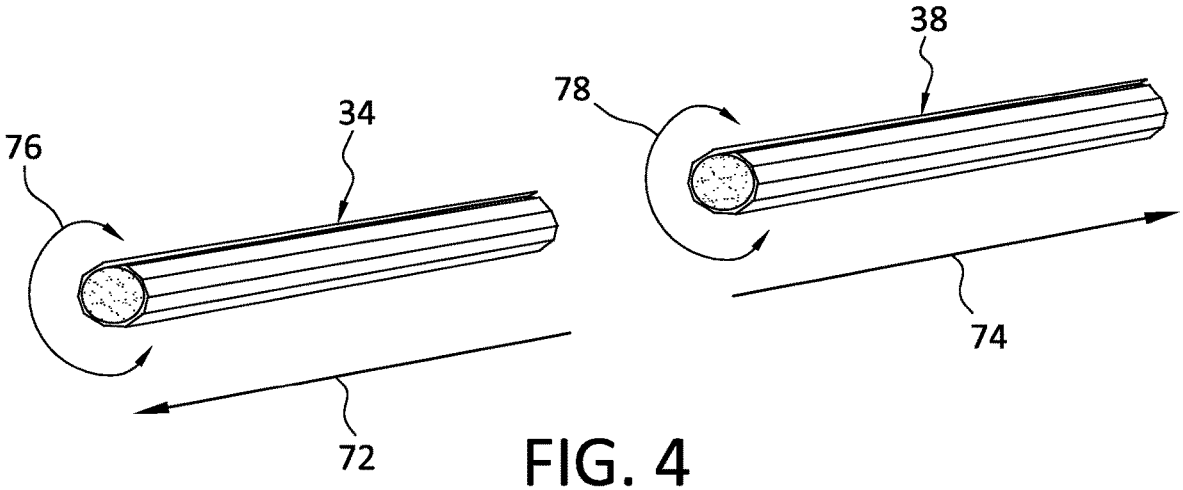
FIG. 4 is a further perspective view of a foldable sheet according to the invention.

As shown in FIG. 4 first half 34 may be rolled up to a smaller diameter than in FIG. 3. A force showing that further rolling up is represented by a double-headed arrow 76. A force showing further rolling up of second half 38 is represented by a double-headed arrow 78.

Figure 5:
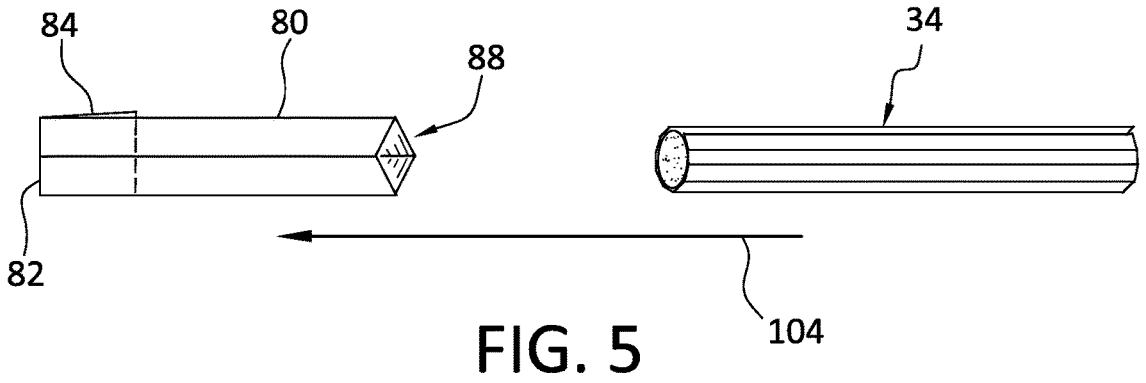
FIG. 5 is a perspective view of a cigarette tube prior to filling according to the invention.

FIG. 5 shows a cigarette tube 80, which may be a substantially rectangular, such as a substantially square cigarette tube, having a closed end 82 with a flap 84 extending outwardly therefrom, and an open end 88. First half 34, filled with smoking material and reduced in diameter, may be inserted into open end 88 of cigarette tube 80 in a direction shown by an arrow 104.

Figure 6:
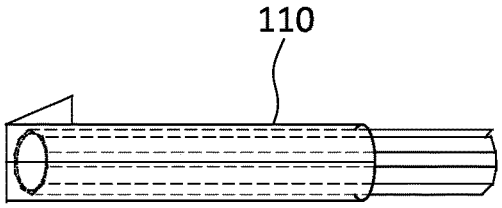
FIG. 6 is a perspective view of the cigarette tube of FIG. 5 in a partially filled position according to the invention.
Figure 7:
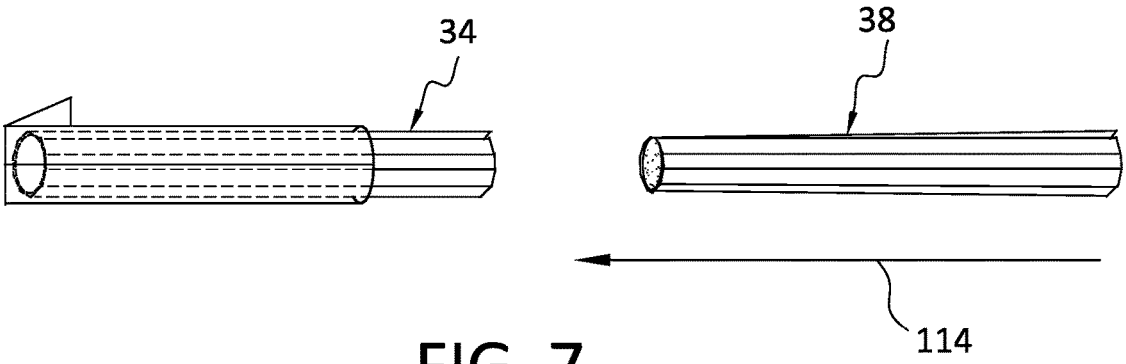
FIG. 7 is a perspective view of the cigarette tube of FIG. 6 in a next partially filled position according to the invention.

FIG. 6 shows first half 34 inserted into cigarette tube 80, now identified as cigarette tube 110, as it has become substantially circular owing to its being filled by first half 34. Then, as shown in FIG. 7, second half 38 is inserted into first half 34 in a direction shown by an arrow 114. Thanks to insertion of second half 38 into first half 34, smoking material 48 in first half 34 may be compressed in first half 34 by second half 38 and held in by place relative to cigarette tube 110 by second half 38.

Figure 8:
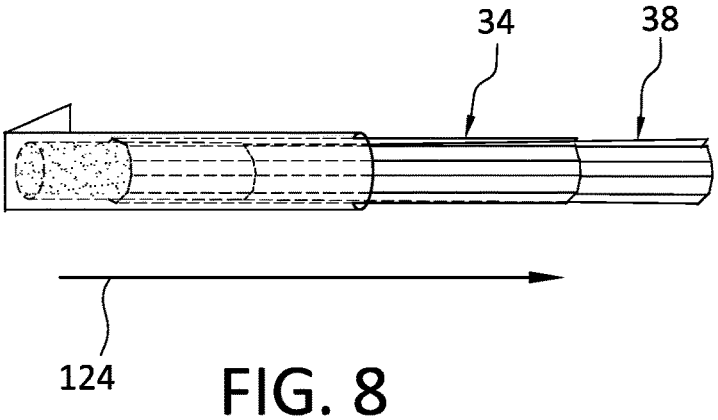
FIG. 8 is a perspective view of the cigarette tube in another partially filled position according to the invention.
Figure 9:
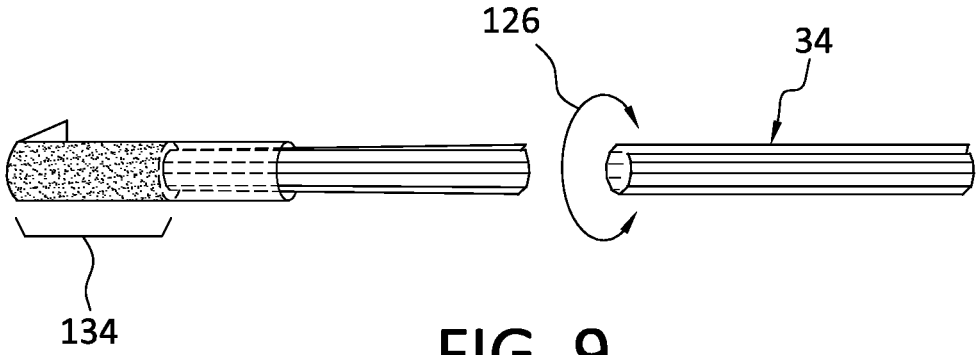
FIG. 9 is a perspective view of the cigarette tube in a further partially filled position according to the invention.

FIG. 8 shows manner in which first half 34 is moved to the right in a direction shown by an arrow 124, so that first half 34 may be emptied and removed from cigarette tube 110, as shown in FIG. 9. FIG. 9 likewise shows that empty first half 34 may be reduced in diameter, and compressed, as shown by a double-headed arrow 126. A section 134 of cigarette tube 110 shows the smoking material removed from first half 34.

Figure 10:
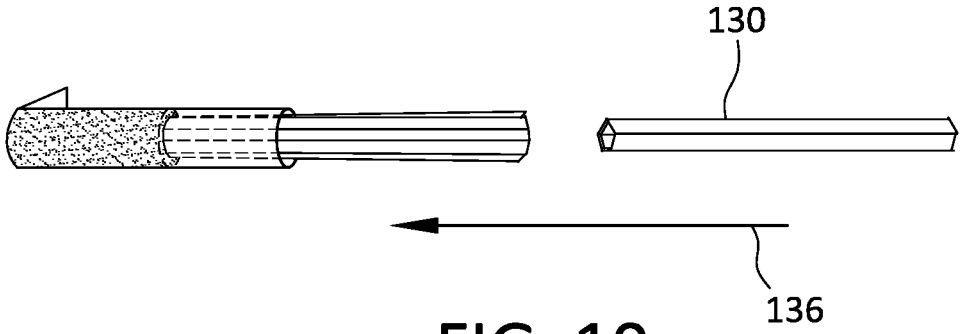
FIG. 10 is a perspective view of the cigarette tube in a another partially filled position after the position of FIG. 9 according to the invention.

FIG. 10 shows a ramrod 130, which may result from the reduction in diameter of empty first half 34 shown in FIG. 9, and which ramrod 130 may be used to remove the smoking material from second half 38 by moving ramrod 130 in a direction of an arrow 136 into second half 38 inside cigarette tube 110. That movement of ramrod 130 may remove and compress smoking material 48 from second half 38 to further fill cigarette tube 110 as shown by a further section 138 of smoking material 48 from second half 38.

Figure 11:
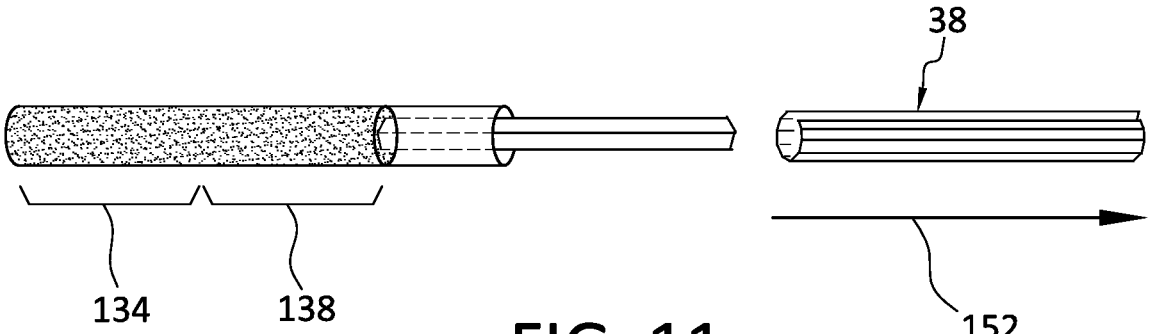
FIG. 11 is a perspective view of the cigarette tube in a further partially filled position after the position of FIG. 10 according to the invention.

FIG. 11 shows ramrod 130 held in place while empty second half 38 is moved to the right in a direction of an arrow 152.

Figure 12:
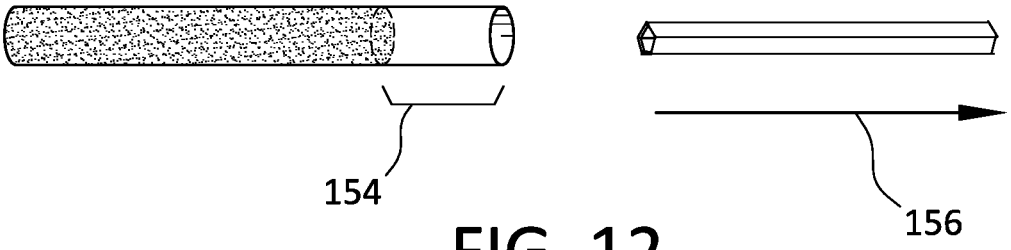
FIG. 12 is a perspective view of the cigarette tube in a filled position after the position of FIG. 11 according to the invention.

FIG. 12 shows an unfilled part 154 of cigarette 110 substantially free of smoking material 48 may be left in cigarette tube 110. It may be seen that ramrod 130 may be moved to the right and outside of cigarette tube 110 in a direction of an arrow 156 for further use as described below.

Figure 13:
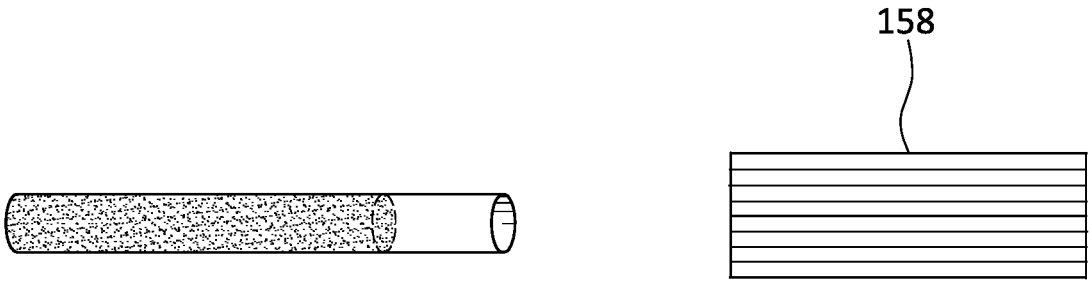
FIG. 13 is a perspective view of the cigarette tube in the filled position of FIG. 12 with another position of a first half of the funnel according to the invention.

FIG. 13 shows a flattened first half 34, which may be the first half 34 used to form ramrod 130, and now flattened as a sheet 158 for further use.

Figure 14:
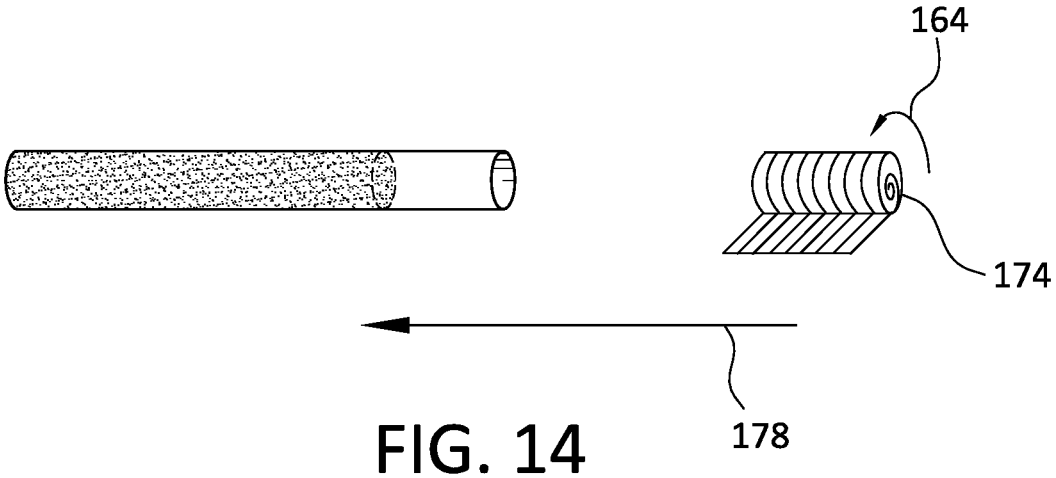
FIG. 14 is a perspective view of the cigarette tube in a filled position showing placement of a filter in the filled position of the cigarette tube according to the invention.

FIG. 14 shows flattened sheet 158 of FIG. 13, which may be rolled up in a direction of an arrow 164 to form a filter 174 for use in cigarette tube 110. Filter 174 may be used by inserting filter 174 into unfilled part 154 in cigarette tube 110.

Figure 15:
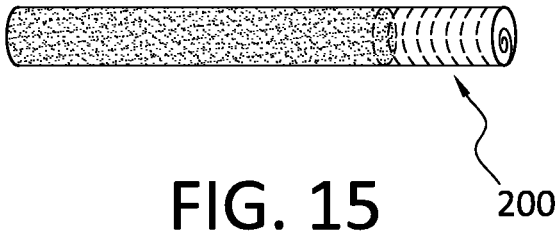
FIG. 15 is a perspective view of a completed filled cigarette according to the invention.

FIG. 15 shows cigarette tube 110 with filter 174 in place therein and forming a completed cigarette 200.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A method of making a cigarette, the method comprising:

a) providing a kit for producing a cigarette, including:

i) a cigarette tube, the cigarette tube holding a smoking material when a smoking material is provided in the cigarette tube;

ii) a funnel, the funnel having a length, a top face, and a bottom face, the funnel includes a fold line along which the bottom face of the funnel is folded relative to the top face of the funnel to form the funnel with the top face having a slot and the bottom face being a being a closed bottom face; the funnel is provided with a first half and a second half; the first half is separated from the second half; the first half fills a section of the cigarette tube with smoking material; and the second half fills a further section of the cigarette tube with smoking material;

iii) the funnel receives the smoking material through the slot and fills the funnel with smoking material for filling the cigarette tube, wherein the cigarette tube is filled with the smokable material; and iv) the funnel is rollable into a filter, and the filter is inserted into an end of the cigarette tube, and the filter filters smoke from the smoking material and the cigarette tube when the cigarette tube and the smoking material are ignited;

b) rolling the funnel rollable into a filter into the filter, and inserting the filter into the end of the cigarette tube, after the funnel rollable into the filter is used as the funnel and fills the cigarette tube with the smokable material; and c) producing a cigarette using the kit.

2. The method of making a cigarette as set forth in claim 1, wherein:

a) the cigarette tube is a circular cigarette tube.

3. The method of making a cigarette as set forth in claim 2, wherein:

a) the circular cigarette tube is rolled from a piece of cigarette paper.

4. The method of making a cigarette as set forth in claim 1, wherein:

a) the cigarette tube is a rectangular cigarette tube.

5. The method of making a cigarette as set forth in claim 4, wherein:

a) the rectangular cigarette tube is made of a piece of cigarette paper.

6. The method of making a cigarette as set forth in claim 1, wherein:

a) the funnel is a paper funnel.

7. The method of making a cigarette as set forth in claim 1, wherein:

a) the cigarette tube is a pre-rolled cigarette tube.

8. The method of making a cigarette as set forth in claim 1, wherein:

a) the fold line is a paper score.

9. The method of making a cigarette as set forth in claim 1, wherein:

a) the cigarette tube includes a piece of cigarette paper.

10. The method of making a cigarette as set forth in claim 1, wherein:

a) the funnel includes card stock.

11. The method of making a cigarette as set forth in claim 1, wherein:

a) the first half pushes smoking material out of the second half to fill the further section of the cigarette tube with smoking material.

12. The method of making a cigarette as set forth in claim 11, wherein:

a) after the first half fills a section of the cigarette tube with smoking material, the first half is flattened, rolled up into a filter, and the filter is inserted into the cigarette tube.

* * * * *